US009626915B2

(12) United States Patent
Park et al.

(10) Patent No.: US 9,626,915 B2
(45) Date of Patent: Apr. 18, 2017

(54) DISPLAY DEVICE WITH DIFFERENT SUB-PIXEL ARRANGEMENTS AND METHOD OF DRIVING THE SAME

(71) Applicants: Jong-Woong Park, Yongin (KR); Won-Woo Jang, Yongin (KR)

(72) Inventors: Jong-Woong Park, Yongin (KR); Won-Woo Jang, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 173 days.

(21) Appl. No.: 13/908,206

(22) Filed: Jun. 3, 2013

(65) Prior Publication Data

US 2014/0078197 A1 Mar. 20, 2014

(30) Foreign Application Priority Data

Sep. 19, 2012 (KR) ..... 10-2012-0104217

(51) Int. Cl.
*G09G 3/36* (2006.01)
*G09G 3/3291* (2016.01)
*G09G 3/20* (2006.01)

(52) U.S. Cl.
CPC ..... *G09G 3/3291* (2013.01); *G09G 3/2003* (2013.01); *G09G 2300/0452* (2013.01); *G09G 2300/0465* (2013.01); *G09G 2340/0457* (2013.01); *G09G 2340/06* (2013.01)

(58) Field of Classification Search
CPC ..... G09G 3/3291; G09G 3/2003; G09G 2300/0452
USPC ..... 345/76, 694
See application file for complete search history.

(56) References Cited

U.S. PATENT DOCUMENTS 7,742,026 B2 6/2010 Lee et al.
2006/0103615 A1* 5/2006 Shih ..... G09G 3/3607 345/88
2007/0159492 A1* 7/2007 Lo ..... G09G 5/026 345/589
2007/0171218 A1* 7/2007 Hong et al. ..... 345/211
2008/0186314 A1* 8/2008 Moriya et al. ..... 345/428
2009/0085847 A1* 4/2009 Morisue et al. ..... 345/88
2009/0167779 A1* 7/2009 Inuzuka ..... G09G 3/2003 345/589
2010/0103187 A1 4/2010 Linssen
2012/0050345 A1 3/2012 Higashi et al.
(Continued)

FOREIGN PATENT DOCUMENTS

CN 1808559 A 7/2006
CN 102636894 A 8/2012
EP 0 541 295 A2 5/1993
(Continued)

OTHER PUBLICATIONS

Extended European Search Report dated Oct. 28, 2014.
(Continued)

*Primary Examiner* — Jonathan Blancha
(74) *Attorney, Agent, or Firm* — Lee & Morse, P.C.

(57) ABSTRACT

A display device has a plurality of pixels, some of which have different sub-pixel arrangements. A first pixel includes only three sub-pixels to emit red, green, and white light, respectively. A second pixel neighbors the first pixel and includes only three sub-pixels to emit blue, green, and white light, respectively.

15 Claims, 8 Drawing Sheets

(56) References Cited

U.S. PATENT DOCUMENTS

2012/0206512 A1 8/2012 Kim et al.

FOREIGN PATENT DOCUMENTS

| | | | |
|---|---|---|---|
| KR | 10/20070011830 | A | 1/2007 |
| KR | 10/20100054242 | A | 5/2010 |
| KR | 10/20110029754 | A | 3/2011 |
| WO | WO 2005/122122 | A1 | 12/2005 |

OTHER PUBLICATIONS

Chinese Patent Office Action issued on Feb. 13, 2017 in the examination of the Chinese Patent Application No. 201310310967.5.

* cited by examiner

DISPLAY DEVICE WITH DIFFERENT SUB-PIXEL ARRANGEMENTS AND METHOD OF DRIVING THE SAME

CROSS-REFERENCE TO RELATED PATENT APPLICATION

The present application claims priority under 35 U.S.C. §119 to and benefit of Korean Patent Application No. 10-2012-0104217, filed on Sep. 19, 2012, in the Korean Intellectual Property Office, and entitled: "Display Device and Method of Driving the Same," which is incorporated by reference herein in its entirety.

BACKGROUND OF THE INVENTION

1. Field of the Invention

Embodiments relate to a display device, and more particularly, to a pixel array of a display device including a white sub-pixel. Embodiments also relate to a method of driving a display device, and more particularly, to a method of driving a pixel array of a display device including a white sub-pixel.

2. Description of the Related Art

In recent fields of organic light-emitting diode (OLED) TVs, white OLED (WOLED) technologies, which are advantageous in manufacturing large OLEDs having high resolution, are being actively discussed, aside from general red, green, and blue (RGB) OLEDs. In a WOLED, color data for realizing white in an RGB signal may be realized without using a color filter as the WOLED additionally includes a white sub-pixel. Also, since the white color data is realized without using a color filter, a reduction in luminous intensity caused by a color filter may not be generated.

Arrangements of red, green, blue, and white (RGBW) sub-pixels used in a display panel of a WOLED display device include a RGBW checker and a RGBW stripe. Such arrangements of the RGBW sub-pixels are different from those of sub-pixels used in a RGB OLED display panel, requiring alteration to a circuit for driving the display panel. For example, in the RGBW checker, the number of scan channels doubles, and a charging time and a driving frequency of a driving circuit are changed. Also, in the RGBW stripe, the number of data channels increases, which increases the number of pads of a source driver and the size of a circuit of the source driver.

SUMMARY

One or more embodiments is directed to providing a display device including: a first pixel including three sub-pixels configured to realize red, green, and white, and a second pixel neighboring the first pixel and including three sub-pixels for realizing blue, green, and white.

The display device may further include a color data converter configured to receive first input color data corresponding to the first pixel and second input color data corresponding to the second pixel, and to generate first output color data each corresponding to red (R), green (G), and white (W) sub-pixels included in the first pixel and second output color data each corresponding to blue (B), green (G), and white (W) sub-pixels included in the second pixel.

Each of the first input color data and the second input color data may include red, green, and blue input color data.

The color data converter may generate the first output color data and the second output color data in such a manner that the red input color data of the second input color data is represented in the R sub-pixel of the first pixel, and the blue input color data of the first input color data is represented in the B sub-pixel of the second pixel.

The color data converter may generate the first output color data and the second output color data in such a manner that the red input color data of the first input color data and the second input color data is represented in at least one of the R sub-pixel and the W sub-pixel of the first pixel and the W sub-pixel of the second pixel, and the blue input color data of the first input color data and the first input color data is represented in at least one of the B sub-pixel and the W sub-pixel of the second pixel and the W sub-pixel of the first pixel.

The color data converter may determine first white output color data by extracting a minimum value from the first input color data and multiplying the extracted minimum value by a first gain ratio.

The color data converter may determine the blue output color data of the second output color data based on a value obtained by subtracting the first white output color data from the blue input color data of the first input color data.

The color data converter may determine second white output color data by extracting a minimum value from the second input color data and multiplying the extracted minimum value by a second gain ratio.

The color data converter may determine the red output color data of the first output color data based on a value obtained by subtracting the second white output color data from the red input color data of the second input color data.

The first pixel and the second pixel may be plural.

The display device may further include: a color data converter configured to receive a plurality of first input color data corresponding to the plurality of first pixels and a plurality of second input color data corresponding to the plurality of second pixels, and configured to generate a plurality of first output color data each corresponding to R, G, and W sub-pixels included in the plurality of first pixels and a plurality of second output color data each corresponding to B, G, and W sub-pixels included in the plurality of second pixels.

The color data converter may generate the plurality of first output color data and the plurality of second output color data in such a manner that the red input color data of the plurality of second input color data is represented in the R sub-pixels of the plurality of first pixels, and the blue input color data of the plurality of first input color data is represented in the B sub-pixels of the plurality of second pixels.

The color data converter may generate the plurality of first output color data and the plurality of second output color data in such a manner that the red input color data of the plurality of first input color data and the plurality of second input color data is represented in at least one of the R sub-pixels and the W sub-pixels of the plurality of first pixels and the W sub-pixels of the plurality of second pixels, and the blue input color data of the plurality of first input color data and the plurality of first input color data is represented in at least one of the B sub-pixels and the W sub-pixels of the plurality of second pixel and the W sub-pixels of the plurality of first pixels.

One or more embodiments is directed to providing a display device including a display panel including one or more unit pixels; a data driver configured to supply three color data signals to each of the one or more unit pixels, a gate driver configured to supply a gate-on voltage to the one or more unit pixels, and a time controller configured to control the data driver and the gate driver, wherein the display panel includes: a first pixel including three sub-pixels configured to realize red, green, and white, and a second pixel neighboring the first pixel and including three sub-pixels for realizing blue, green, and white.

The timing controller may receive red, green, and blue first input color data corresponding to the first pixel and red, green, and blue second input color data corresponding to the second pixel.

The timing controller may generate the first output color data and the second output color data in such a manner that the red input color data of the first input color data and the second input color data is represented in at least one of the R sub-pixel and the W sub-pixel of the first pixel and the W sub-pixel of the second pixel, and the blue input color data of the first input color data and the first input color data is represented in at least one of the B sub-pixel and the W sub-pixel of the second pixel and the W sub-pixel of the first pixel.

The timing controller may determine first white output color data by extracting a minimum value from the first input color data and multiplying the extracted minimum value by a first gain ratio.

The timing controller may determine the blue output color data of the second output color data based on a value obtained by subtracting the first white output color data from the blue input color data of the first input color data.

The first pixel and the second pixel may be plural.

The timing controller may supply first output color data each corresponding to R, G, and W sub-pixels or second output color data each corresponding to B, G, and W sub-pixels to the data driver.

The three data signals supplied by the data driver may be three data signals corresponding to red, green, and white output color data or three data signals corresponding to blue, green, and white output color data.

One or more embodiments is directed to providing a method of driving a display panel, the method including: receiving first input color data corresponding to a first pixel and second input color data corresponding to a second pixel, wherein a color data converter performs the receiving; and generating first output color data each corresponding to R, G, and W sub-pixels included in the first pixel and second output color data each corresponding to B, G, and W sub-pixels included in the second pixel, wherein a color data converter performs the generating, wherein each of the first input color data and the second input color data includes red, green, and blue input color data.

The method may further include: generating the first output color data and the second output color data in such a manner that the red input color data of the second input color data is represented in the R sub-pixel of the first pixel, and the blue input color data of the first input color data is represented in the B sub-pixel of the second pixel, wherein the color data converter performs the generating.

The method may further include: generating the first output color data and the second output color data in such a manner that the red input color data of the first input color data and the second input color data is represented in at least one of the R sub-pixel and the W sub-pixel of the first pixel and the W sub-pixel of the second pixel, and the blue input color data of the first input color data and the first input color data is represented in at least one of the B sub-pixel and the W sub-pixel of the second pixel and the W sub-pixel of the first pixel, wherein the color data converter performs the generating.

The method may further include: receiving the first output color data and the second output color data, wherein a data driver performs the receiving; supplying a gate-on voltage to a plurality of unit pixels, wherein a gate driver performs the supplying; and supplying a data signal to each pixel corresponding to the first output color data and the second output color data, wherein the data driver performs the supplying.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
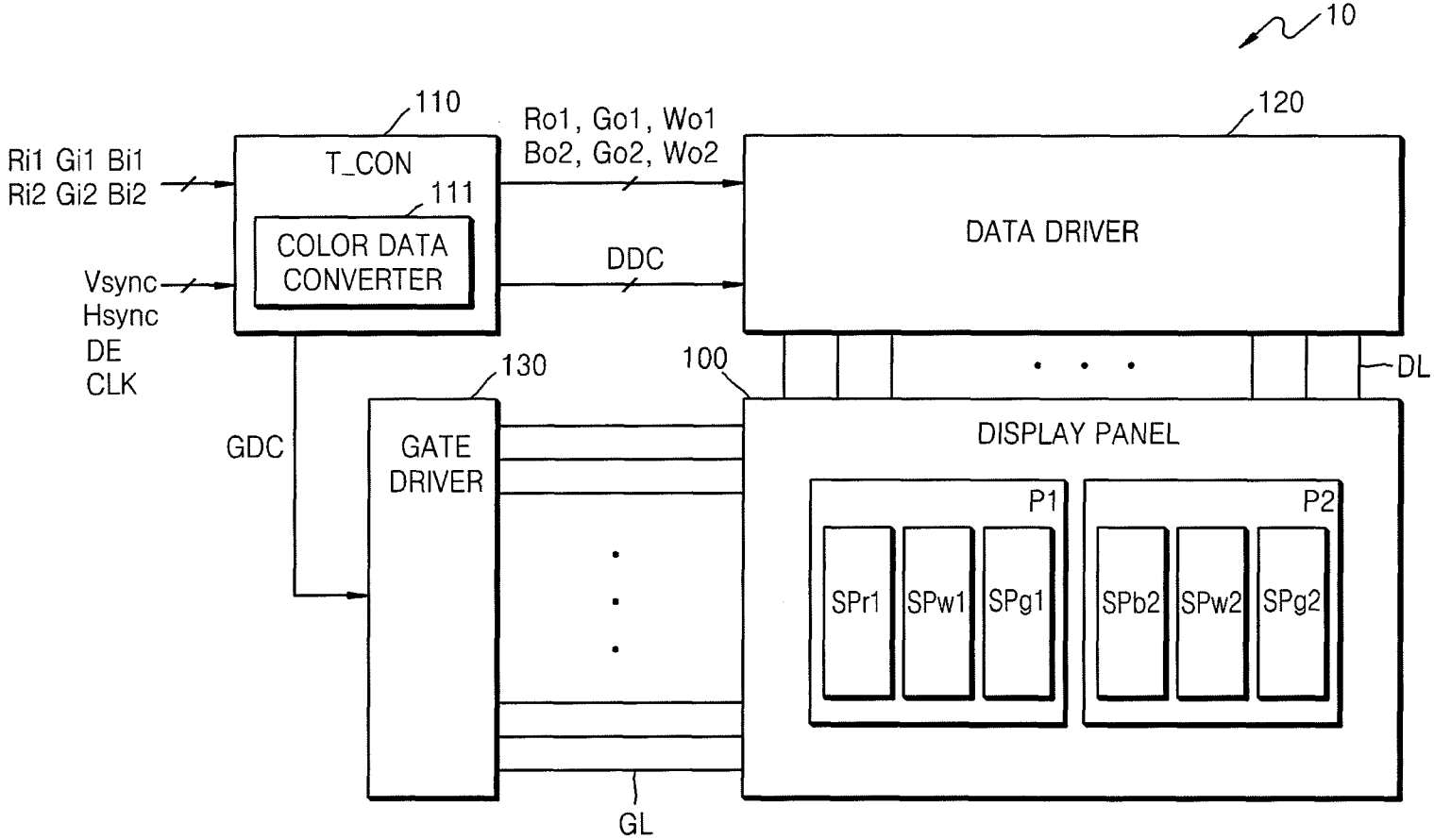
FIG. 1 illustrates a block diagram of a display device, according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings herein.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the term "and/or" includes any and all combinations of one or more of the associated listed items.

FIG. 1 illustrates a block diagram of a display device 10 according to an embodiment. Referring to FIG. 1, the display device 10 may include a display panel 100, a time controller 110, a data driver 120, and a gate driver 130.

In the display panel 100, a plurality of data lines DL and a plurality of gate lines GL cross each other, and a plurality of pixels P1 and P2 each including three sub-pixels are arranged in crossing regions.

The pixel P1 may include a red (R) sub-pixel SPr1 for emitting R light, a green (G) sub-pixel SPg1 for emitting G light, and a white (W) sub-pixel SPw1 for emitting W light. Thus, blue (B) light may not be emitted by the pixel P1, but may be represented through rendering of peripheral, e.g., directly adjacent, pixels. For example, the B light may be represented through rendering of the pixel P2.

The pixel P2 neighboring the pixel P1 may include a blue (B) sub-pixel SPb2 for emitting B light, a green (G) sub-pixel SPg2 for emitting G light, and a white (W) sub-pixel SPw2 for emitting W light. Thus, R light may not be emitted by the pixel P2, but may be represented through rendering of peripheral, e.g., directly adjacent, pixels. For example, the R light may be represented through rendering of the pixel P1.

According to an embodiment of, each of the plurality of pixels P1 and P2 included in the display panel 100 may include three sub-pixels. Each of the plurality of pixels P1 and P2 may not include the R sub-pixel or the B sub-pixel, respectively, and may implement light data with respect to the R sub-pixel or the B sub-pixel through rendering of the neighboring pixels P2 or P1. The combination of the pixels P1 and P2 allow the display 10 to provide a full color image. While two pixels are shown in FIG. 1 for convenience of description, the number of pixels included in the display panel 100 may vary according to an application.

FIGS. 2A through 2H illustrate various arrangements of sub-pixels in a display panel. In particular, FIGS. 2A through 2H each illustrate four pixels, each pixel including three sub-pixels. In all of the arrangements, the pixels are alternately arranged such that each pixel directly adjacent linearly along a row or column direction to a current pixel will have at least one different sub-pixel than the current pixel, e.g., if the current pixel has a red sub-pixel, all pixels directly adjacent linearly along a row or column direction will have a blue sub-pixel, instead of a red sub-pixel. The order of the remaining sub-pixels within the pixels may be the same.

Figure 2A:
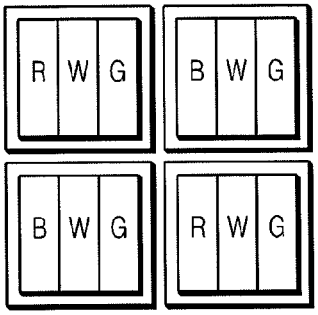
FIGS. 2A through 2H illustrate various arrangements of sub-pixels in a display panel.
Figure 2B:
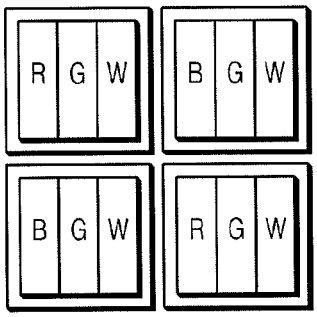
Figure 2C:
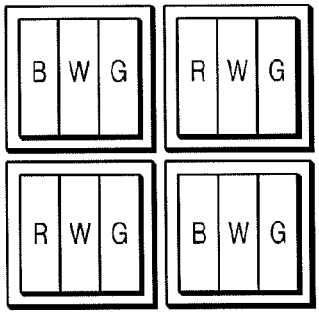
Figure 2D:
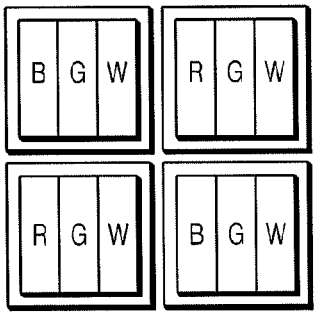
Figure 2E:
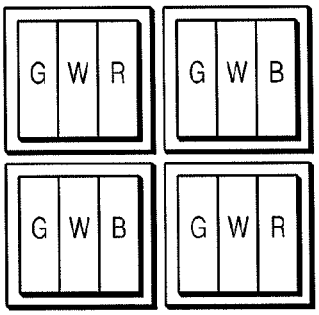
Figure 2F:
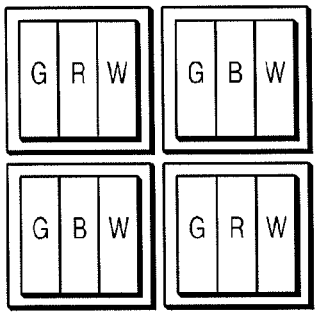
Figure 2G:
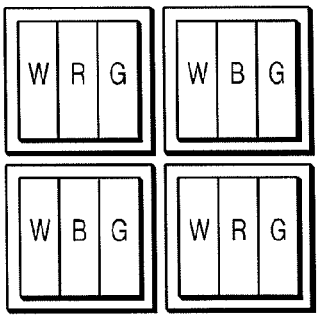
Figure 2H:
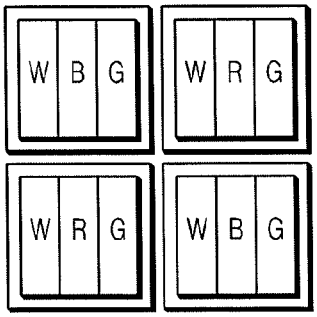

Referring to FIG. 2A, a first pixel in a first row and a first column may include three sub-pixels in the order of RWG; a second pixel in the first row and a second column may include three sub-pixels in the order of BWG; a third pixel in a second row and the first column may include three sub-pixels in the order of BWG; and a fourth pixel in the second row and second column in the order of RWG. Each of the three sub-pixels may have a stripe type arrangement where three data lines and one gate line cross each other.

FIGS. 2B through 2H illustrate alternate arrangements of sub-pixels. Referring to FIGS. 2B through 2H, each pixel may include a W sub-pixel and a G sub-pixel, and, alternately, an R sub-pixel or a B sub-pixel. Arrangement of the three sub-pixels within the same pixel may be modified in various ways as shown in FIGS. 2A through 2H.

Figure 3:
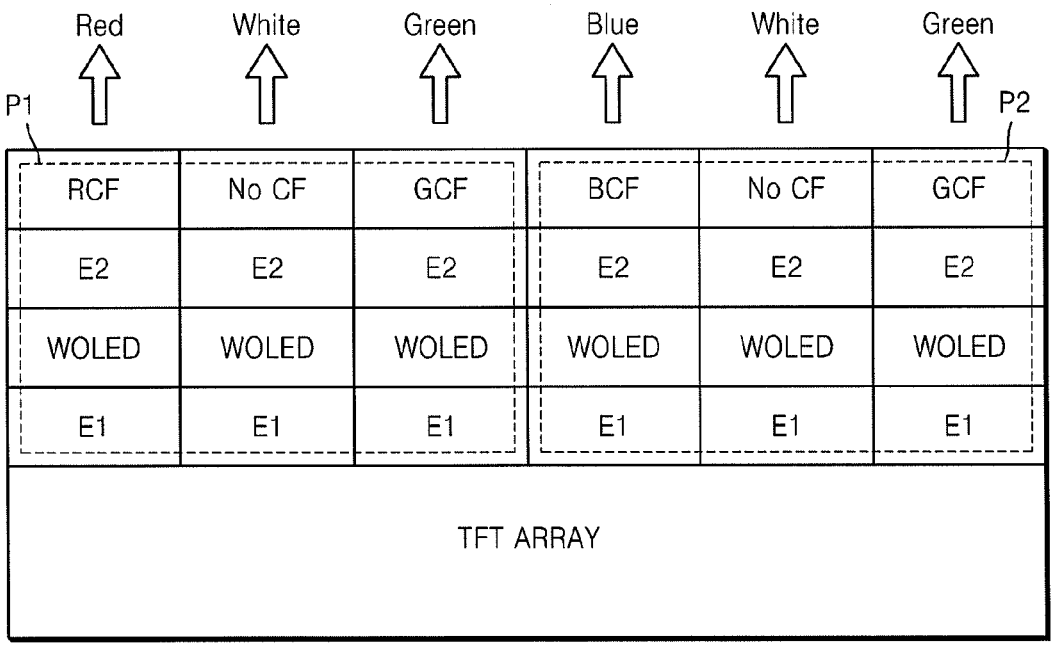
FIG. 3 illustrates a diagram of a stacked structure of sub-pixels in two pixels of FIG. 1.

FIG. 3 illustrates a diagram of a stacked structure of sub-pixels in the pixels P1 and P2 of FIG. 1 according to an embodiment. Referring to FIG. 3, the pixel P1 may include the sub-pixels SPr1, SPw1, and SPg1, and the pixel P2 may include the sub-pixels SPb2, SPw2, and SPg2.

The sub-pixels SPr1, SPw1, SPg1, SPb2, SPw2, and SPg2 may each include a white organic light-emitting diode (WOLED). The WOLED may have a multilayer structure in which an R emission layer, a G emission layer, and a B emission layer are stacked to emit white light between a cathode and an anode, or may have a monolayer structure including an R emission material, a G emission material, and a B emission material.

As shown in FIG. 3, the R sub-pixel SPr1 may include an R color filter RCF through which only red light is transmitted, the G sub-pixels SPg1 and SPg2 may include a G color filter GCF through which only green light is transmitted, and the B sub-pixel SPb2 may include a B color filter BCF through which only blue light is transmitted. However, the W sub-pixels SPw1 and SPw2 do not include a color filter, i.e., all of the white light from the WOLED is transmitted therethrough, and may compensate for luminance deterioration of an image caused by the R, G, and B color filters RCF, GCF, and BCF.

In FIG. 3, E1 may be an anode (or a cathode) and E2 may be a cathode (or an anode). E1 is electrically connected to a driving thin film transistor (TFT) formed in a lower TFT array in sub-pixel units. The lower TFT array may include a driving TFT, at least one switch TFT, and a storage capacitor according to sub-pixels, and is connected to a data line DL and a gate line GL in sub-pixel units.

Referring back to FIG. 1, the data driver 120 converts output color data Ro1, Go1, Wo1, Bo2, Go2, and Wo2 of which color coordinates are converted into an analog data voltage and supplies the analog data voltage to the data lines DL, under the control of the time controller 110.

The gate driver 130 selects a horizontal line to which a gate-on voltage is to be applied, by generating and supplying a scan pulse sequentially to the gate lines GL under the control of the time controller 110.

The time controller 110 generates a data control signal DDC for controlling an operation timing of the data driver 120 and a gate control signal GDC for controlling an operation timing of the gate driver 130, based on timing signals, e.g., a vertical synchronization signal Vsync, a horizontal synchronization signal Hsync, a clock signal CLK, a data enable signal DE, and so forth.

The time controller 110 may include a color data converter 111. The color data converter 111 may receive input color data Ri1, Gi1, Bi1, Ri2, Gi2, and Bi2 of three colors from outside the display device 10, and supply the output color data Ro1, Go1, Wo1, Bot, Go2, and Wo2 having converted color coordinates to the data driver 120. However, the color data converter 111 may be realized in the data driver 120 or a separate chip, and may vary according to an application.

According to an embodiment, the display device 10 may include the display panel 100 including the pixel P1 including the sub-pixels each realizing R color, G color, and W color, and the pixel P2 including the sub-pixels each realizing B color, G color, and W color. Since each pixel still only has three sub-pixels, a driving circuit used to realize the RGB OLED may be used, thus avoiding an increase in the number of scan channels and data channels, while using rendering to display a full color image. A display driving operation will now be described in detail.

Figure 4A:
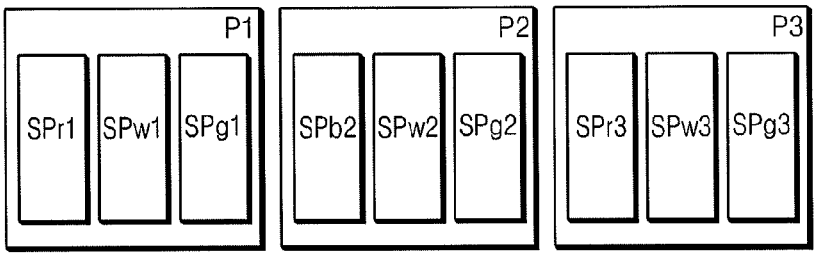
FIG. 4A illustrates an exemplary diagram of first through third pixels for explaining rendering implemented between two pixels, according to an embodiment.

FIG. 4A illustrates an exemplary diagram of the pixel P1, the pixel P2, and a pixel P3 for explaining rendering implemented between two pixels, according to an embodiment. Referring to FIG. 4A, the pixels P1 and P3 may include R, W, and G sub-pixels, and the pixel P2 may include B, W, and G sub-pixels. The pixel P1 has no sub-pixel that emits blue light and the pixel P2 has no sub-pixel that emits red light. Thus, blue input color data corresponding to the pixel P1 may be represented through rendering of the pixel P2, and red input color data corresponding to the pixel P2 may be represented through rendering of the pixel P3.

Figure 4B:
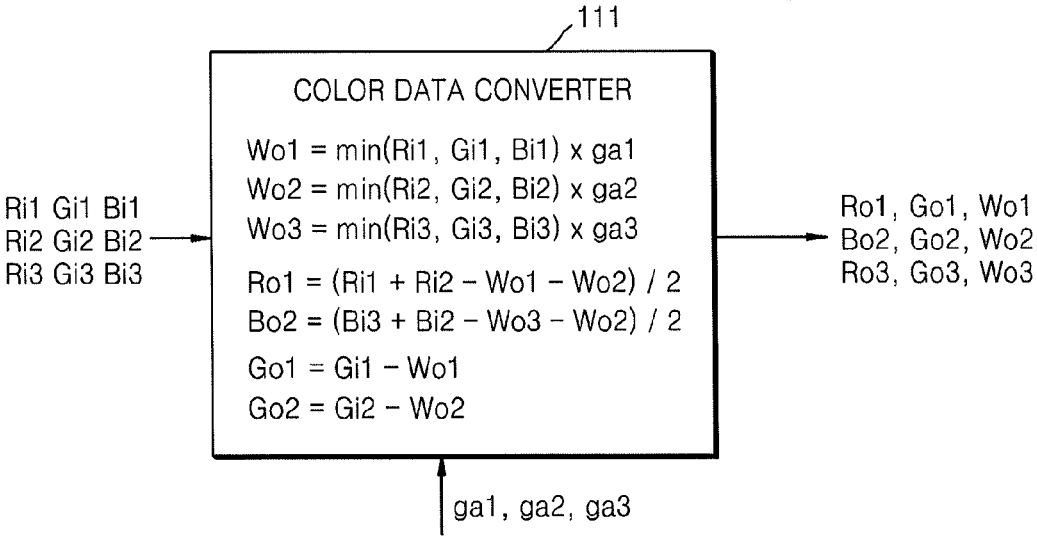
FIG. 4B illustrates a diagram of a color data converter for explaining rendering implemented between two pixels, according to an embodiment.

FIG. 4B illustrates a diagram of the color data converter 111 for explaining rendering implemented between two pixels, according to an embodiment. Referring to FIG. 4B, the color data converter 111 may receive input color data Ri1, Gi1, Bi1, Ri2, Gi2, Bi2, Ri3, Gi3, and Bi3 of three colors and generate output color data Ro1, Go1, Wo1, Bo2, Go2, Wo2, Ro3, Go3, and Wo3 having converted color coordinates. The color data converter 111 may receive gain ratios ga1, ga2, and ga3 that are used to generate the output color data Ro1, Go1, Wo1, Bo2, Go2, Wo2, Ro3, Go3, and Wo3.

More specifically, the color data converter 111 may calculate the white output color data Wo1, Wo2, and Wo3 realized in each pixel from the input color data Ri1, Gi1, Bi1, Ri2, Gi2, Bi2, Ri3, Gi3, and Bi3, respectively, corresponding to the pixels P1, P2, and P3. For example, the color data converter 111 may calculate the white output color data Wo1 realized in the pixel P1 by multiplying a minimum value of the input color data Ri1, Gi1, and Bi1 by the first gain ratio ga1. For example, the color data converter 111 may calculate the white output color data Wo2 realized in the pixel P2 by multiplying a minimum value of the input color data Ri2, Gi2, and Bi2 by the second gain ratio ga2. For example, the color data converter 111 may calculate the white output color data Wo3 realized in the pixel P3 by multiplying a minimum value of the input color data Ri3, Gi3, and Bi3 by the third gain ratio ga3. Such processes may be represented by Equation 1 below:

$$Wo1=\min(Ri1,Gi1,Bi1)\times ga1$$

$$Wo2=\min(Ri2,Gi2,Bi2)\times ga2$$

$$Wo3=\min(Ri3,Gi3,Bi3)\times ga3 \quad \text{[Equation 1]}$$

The first through third gain ratios ga1, ga2, and ga3 are numbers between 0 and 1. The first through third gain ratios ga1, ga2, and ga3 may be input from the outside of the color data converter 111.

Two methods may be used to realize white while driving each sub-pixel included in a display panel. In particular, white may be realized by using a W sub-pixel without using a color filter or by combining red, green, and blue realized via RGB color filters. A gain ratio is a ratio of the two methods used to realize white. Thus, when the gain ratio is high, a ratio of realizing white by using a W sub-pixel is high, and when the gain ratio is low, a ratio of realizing white by using R, G, and B sub-pixels is high.

The color data converter 111 may use the calculated white output color data Wo1, Wo2, and Wo3 to calculate the red and green output color data Ro1 and Go1 realized in the pixel P1 and the blue and green output color data Bo2 and Got realized in the pixel P2.

The color data converter 111 may determine the red output color data Ro1 corresponding to the pixel P1 based on the input color data Ri2, Gi2, and Bi2 corresponding to the pixel P2. For example, the color data converter 111 may determine the red output color data Ro1 realized in the pixel P1 as a value obtained by dividing a sum of the white color output data Wo1 and Wo2 subtracted from a sum of the red input color data Ri1 and Ri2 by 2. That is, red light may be realized in the pixel P2 through rendering of the pixel P1.

The color data converter 111 may determine the blue output color data Bo1 corresponding to the pixel P2 based on the input color data Ri3, Gi3, and Bi3 corresponding to the pixel P3. For example, the color data converter 111 may determine the blue output color data Bo2 realized in the pixel P2 as a value obtained by dividing a sum of the white color output data Wo2 and Wo3 subtracted from a sum of the blue input color data Bi2 and Bi3 by 2. That is, blue light may be represented in the pixel P3 through rendering of the pixel P2.

Further, the color data converter 111 may determine the green output color data Go1 realized in the pixel P1 by subtracting the white output color data Wo1 from the green input color data Gi1. The color data converter 111 may also determine the green output color data Go2 realized in the pixel P2 by subtracting the white output color data Wo2 from the green input color data Gi2.

Such processes may be represented by Equation 2 below:

$$Ro1=(Ri1+Ri2-Wo1-Wo2)/2$$

$$Bo2=(Bi3+Bi2-Wo3-Wo2)/2$$

$$Go1=Gi1-Wo1$$

$$Go2=Gi2-Wo2 \quad \text{[Equation 2]}$$

Therefore, according to an embodiment, the display panel may realize blue color through the rendering of a neighboring pixel when the current pixel does not include a B sub-pixel, and may realize red color through the rendering of a neighboring pixel while the current pixel does not include a R sub-pixel. In the particular example noted above in FIGS. 4A and 4B, the neighboring pixel used is one immediately to the left of the current pixel, but other directly adjacent pixels and/or more than one neighboring pixel may be used for the rendering.

Therefore, one pixel may include only three sub-pixels to realize a full color image. Thus, the same driving circuit as the driving circuit using RGB sub-pixels may be used, thereby preventing an area of the driving circuit, a charging time thereof, and a driving frequency thereof from changing, e.g., without an increase in the number of scan channels or data channels.

Figure 5A:
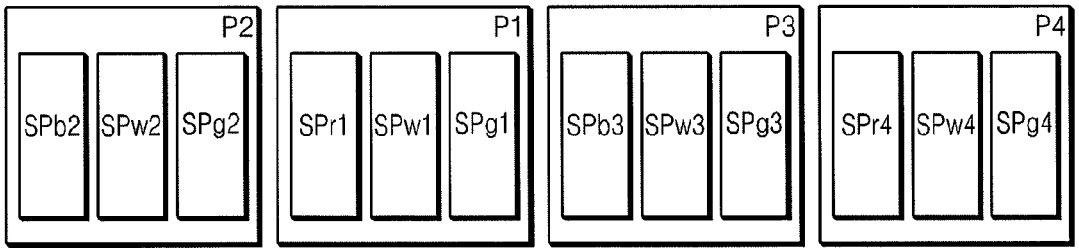
FIG. 5A illustrates an exemplary diagram of first through fourth pixels for explaining rendering implemented between three pixels, according to an embodiment.

FIG. 5A illustrates an exemplary diagram of the pixel P1, the pixel P2, the pixel P3, and a pixel P4 for explaining rendering implemented between three pixels, according to an embodiment.

Referring to FIG. 5A, the pixels P1 and P4 may include R, W, and G sub-pixels, and the pixels P2 and P3 may include B, W, and G sub-pixels. The pixels P1 and P4 have no sub-pixel that emits blue light. The pixels P2 and P3 have no sub-pixel that emits red light. Thus, blue input color data corresponding to the pixel P1 may be represented through rendering of the pixels P2 and P3, and red input color data corresponding to the pixel P2 may be represented through rendering of the pixels P1 and P4.

Figure 5B:
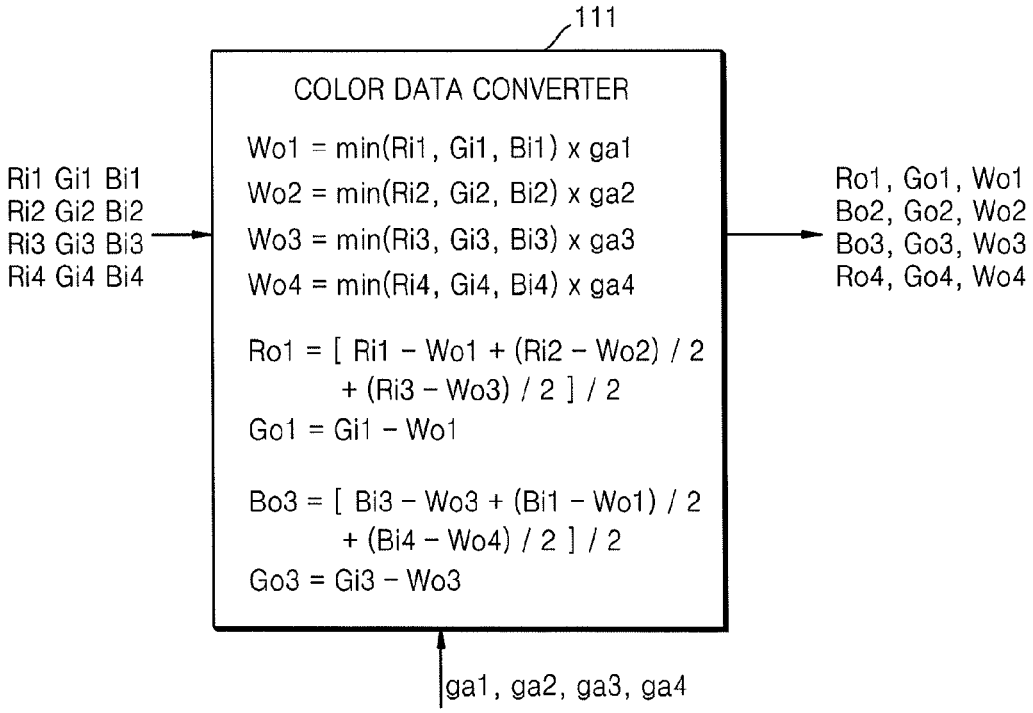
FIG. 5B illustrates a diagram of a color data converter for explaining rendering implemented between three pixels, according to an embodiment.

FIG. 5B illustrates a diagram illustrating the color data converter 111 for explaining rendering implemented between three pixels, according to an embodiment of the present invention.

Referring to FIG. 5B, the color data converter 111 may receive input color data Ri1, Gi1, Bi1, Ri2, Gi2, Bi2, Ri3, Gi3, Bi3, Ri4, Gi4, and Bi4 of three colors and generate output color data Ro1, Go1, Wo1, Bo2, Go2, Wo2, Bo3, Go3, Wo3, Ro4, Go4, and Wo4 having converted color coordinates. The color data converter 111 may receive gain ratios ga1, ga2, ga3, and ga4 that are used to generate the output color data Ro1, Go1, Wo1, Bo2, Go2, Wo2, Bo3, Go3, Wo3, Ro4, Go4, and Wo4.

More specifically, the color data converter 111 may calculate the white output color data Wo1, Wo2, Wo3, and Wo4 realized in each pixel from the input color data Ri1, Gi1, Bi1, Ri2, Gi2, Bi2, Ri3, Gi3, Bi3, Ri4, Gi4, and Bi4 corresponding to the pixels P1, P2, P3, and P4. For example, the color data converter 111 may calculate the white output color data Wo1 realized in the pixel P1 by multiplying a minimum value of the input color data Ri1, Gi1, and Bi1, and the first gain ratio ga1. The color data converter 111 may calculate the white output color data Wo2, Wo3, and Wo4 in the same manner as stated with respect to the white output color data Wo1 above. Such processes may be represented by Equation 3 below:

$$Wo1=\min(Ri1,Gi1,Bi1)\times ga1$$

$$Wo2=\min(Ri2,Gi2,Bi2)\times ga2$$

$$Wo3=\min(Ri3,Gi3,Bi3)\times ga3$$

$$Wo4=\min(Ri4,Gi4,Bi4)\times ga4 \quad \text{[Equation 3]}$$

In this regard, the first through fourth gain ratios ga1, ga2, ga3, and ga4 are numbers between 0 and 1. The detailed description of the gain ratios ga1, ga2, ga3, and ga4 as set forth above with reference to FIG. 4B.

The color data converter 111 may determine the red output color data Ro1 corresponding to the pixel P1 based on the input color data Ri2, Gi2, and Bi2 corresponding to the pixel P2 and the input color data Ri3, Gi3, and Bi3 corresponding to the pixel P3. For example, the color data converter 111 may determine the red output color data Ro1 realized in the pixel P1 as a value obtained by dividing a sum of a value obtained by dividing a value obtained by subtracting the white output color data Wo1 from the red input color data Ri1 by 2, a value obtained by dividing a value obtained by subtracting the white output color data Wo2 from the red input color data Ri2 by 2, and a value obtained by dividing a value obtained by subtracting the white output color data Wo3 from the red input color data Ri3 by 2, by 2. That is, red light may be represented in the pixels P2 and P3 through rendering of the pixel P1.

The color data converter 111 may determine the green output color data Go1 corresponding to the pixel P1 as a value obtained by subtracting the white output color data Wo1 from the green input color data Gi1.

Such process may be represented by Equation 4 below:

$$Ro1=[Ri1-Wo1+(Ri2-Wo2)/2+(Ri3-Wo3)/2]/2$$

$$Go1=Gi1-Wo1 \quad \text{[Equation 4]}$$

The color data converter 111 may determine the blue output color data Bo3 corresponding to the pixel P3 based on the input color data Ri1, Gi1, and Bi1 corresponding to the pixel P1 and the input color data Ri4, Gi4, and Bi4 corresponding to the pixel P4. For example, the color data converter 111 may determine the blue output color data Bo3 realized in the pixel P3 as a value obtained by dividing a sum of a value obtained by dividing a value obtained by subtracting the white output color data Wo3 from the blue input color data Bi3 by 2, a value obtained by dividing a value obtained by subtracting the white output color data Wo1 from the blue input color data Bi1 by 2, and a value obtained by dividing a value obtained by subtracting the white output color data Wo4 from the blue input color data Bi4 by 2, by 2. That is, blue light may be represented in the pixels P1 and P4 through rendering of the pixel P3.

The color data converter 111 may determine the green output color data Go3 corresponding to the pixel P3 as a value obtained by subtracting the white output color data Wo1 from the green input color data Gi3.

Such process may be represented by Equation 5 below:

$$Bo2=[Bi3-Wo3+(Bi1-Wo1)/2+(Bi4-Wo4)/2]/2$$

$$Go3=Gi3-Wo3 \quad \text{[Equation 5]}$$

Therefore, according to an embodiment, the display panel may realize blue color through the rendering of the second pixel P2 and the third pixel P3 among the first through fourth pixel for the first pixel P1 that does not include a B sub-pixel, and may realize red color through the rendering of the first pixel P1 and the fourth pixel P4 for the third pixel P3 that does not include a R sub-pixel. Therefore, each pixel may include only three sub-pixels, one of which is a white sub-pixel, while providing a full color image. Thus, the same driving circuit as the driving circuit using RGB sub-pixels may be used, thereby preventing an area of the driving circuit, a charging time thereof, and a driving frequency thereof from changing without an increase in the number of scan channels or data channels.

Figure 6A:
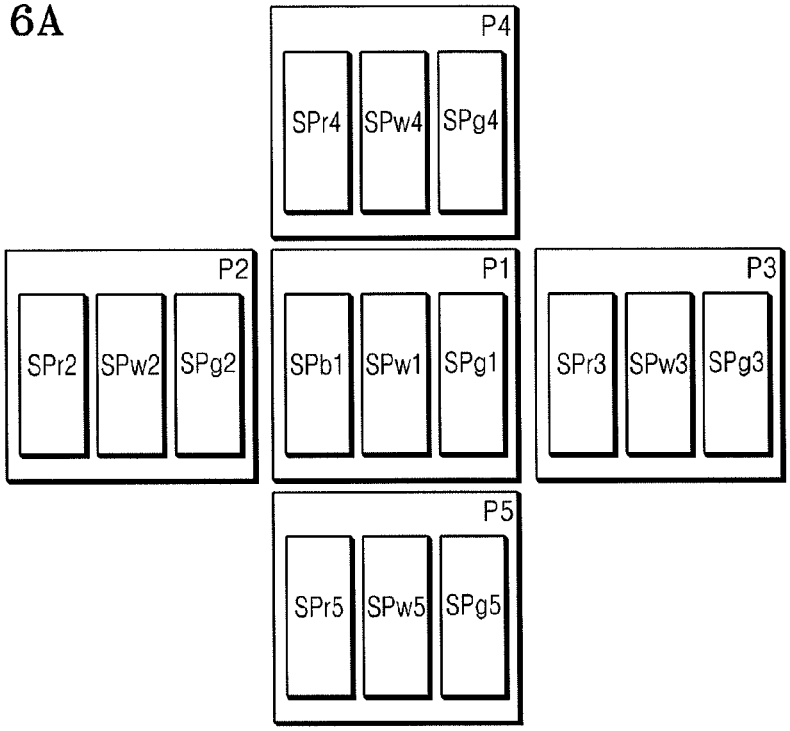
FIG. 6A illustrates an exemplary diagram of first through fifth pixels for explaining rendering implemented between five pixels according to an embodiment.

FIG. 6A illustrates an exemplary diagram of the pixel P1, the pixel P2, the pixel P3, the pixel P4, and a pixel P5 for explaining rendering implemented between five pixels according to an embodiment.

Referring to FIG. 6A, the pixel P1 may include B, W, and G sub-pixels, and the pixels P2 through P5 may include R, W, and G sub-pixels. The pixels P2 through P5 have no sub-pixel for realizing blue light. The pixel P1 has no sub-pixel for realizing red light. Thus, blue input color data corresponding to the pixels P2 through P5 may be represented through rendering of the pixel P1.

Figure 6B:
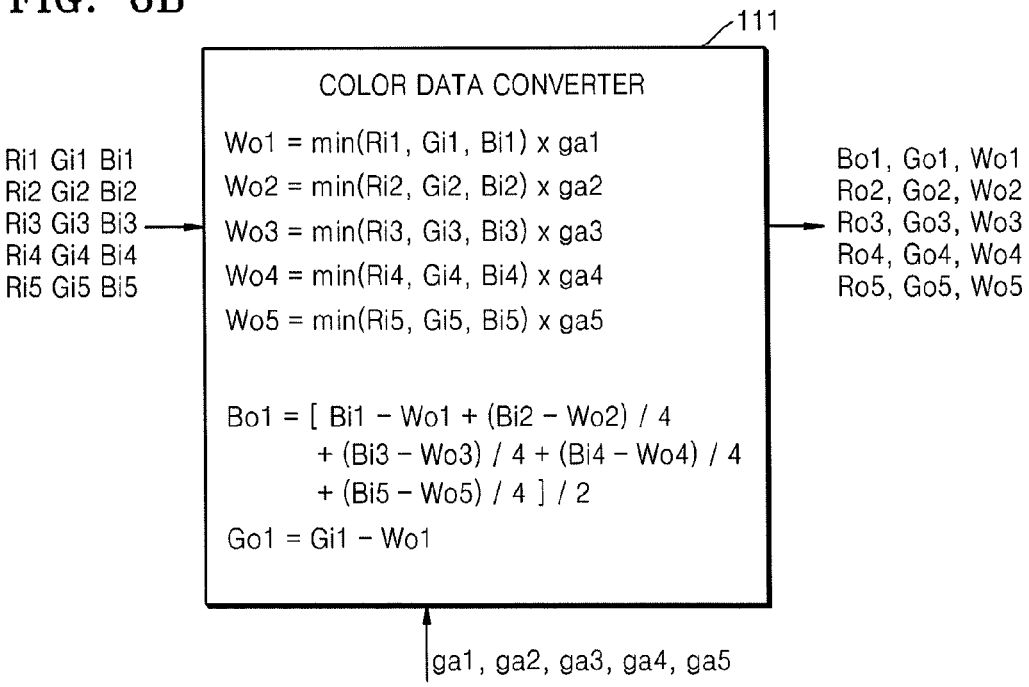
FIG. 6B illustrates a diagram of a color data converter for explaining rendering implemented between five pixels, according to an embodiment.

FIG. 6B illustrates a diagram illustrating the color data converter 111 for explaining rendering implemented between five pixels, according to an embodiment of the present invention.

Referring to FIG. 6B, the color data converter 111 may receive input color data Ri1, Gi1, Bi1, Ri2, Gi2, Bi2, Ri3, Gi3, Bi3, Ri4, Gi4, Bi4, Ri5, Gi5, and Bi5 of 3 colors and generate output color data Bo1, Go1, Wo1, Ro2, Go2, Wo2, Ro3, Go3, Wo3, Ro4, Go4, Wo4, Ro5, Go5, and Wo5 of which color coordinates are converted. The color data converter 111 may receive gain ratios ga1, ga2, ga3, ga4, and ga5 that are used to generate the output color data Bo1, Go1, Wo1, Ro2, Go2, Wo2, Ro3, Go3, Wo3, Ro4, Go4, Wo4, Ro5, Go5, and Wo5.

More specifically, the color data converter 111 may calculate the white output color data Wo1, Wo2, Wo3, Wo4, and Wo5 realized in each pixel from the input color data Ri1, Gi1, Bi1, Ri2, Gi2, Bi2, Ri3, Gi3, Bi3, Ri4, Gi4, Bi4, Ri5, Gi5, and Bi5 corresponding to the pixels P1 and P2. For example, the color data converter 111 may calculate the white output color data Wo1 realized in the pixel P1 by multiplying a minimum value of the input color data Ri1, Gi1, and Bi1 by the first gain ratio ga1. The color data converter 111 may calculate the white output color data Wo2, Wo3, Wo4, and Wo5 in the same manner as stated with respect to the white output color data Wo1 above. Such processes may be represented by Equation 6 below:

$$Wo1=\min(Ri1,Gi1,Bi1)\times ga1$$

$$Wo2=\min(Ri2,Gi2,Bi2)\times ga2$$

$$Wo3=\min(Ri3,Gi3,Bi3)\times ga3$$

$$Wo4=\min(Ri4,Gi4,Bi4)\times ga4$$

$$Wo5=\min(Ri5,Gi5,Bi5)\times ga5 \quad \text{[Equation 6]}$$

In this regard, the first through fourth gain ratios ga1, ga2, ga3, ga4, and ga5 are numbers between 0 and 1. The detailed description of gain ratios is set forth above with reference to FIG. 4B.

The color data converter 111 may determine the blue output color data Bo1 corresponding to the pixel P1 based on the input color data Ri1, Gi1, Bi1, Ri2, Gi2, Bi2, Ri3, Gi3, Bi3, Ri4, Gi4, Bi4, Ri5, Gi5, and Bi5 corresponding to the pixels P2 through P5. For example, the color data converter 111 may determine the blue output color data Bo1 realized in the pixel P1 as a value obtained by dividing a sum of a value obtained by dividing a value obtained by subtracting the white output color data Wo1 from the blue input color data Bi1 by 2, a value obtained by dividing a value obtained by subtracting the white output color data Wo2 from the blue input color data Bi2 by 2, a value obtained by dividing a value obtained by subtracting the white output color data Wo3 from the blue input color data Bi3, a value obtained by dividing a value obtained by subtracting the white output color data Wo4 from the blue input color data Bi4, and a value obtained by dividing a value obtained by subtracting the white output color data Wo5 from the blue input color data Bi5 by 2, by 2. That is, blue light may be represented in the pixels P2 through P5 through rendering of the pixel P1.

The color data converter 111 may determine the green output color data Go1 corresponding to the pixel P1 as a value obtained by subtracting the white output color data Wo1 from the green input color data Gi1.

Such a process may be represented by Equation 7 below:

$$Bo1=[Bi1-Wo1+(Bi2-Wo2)/4+(Bi3-Wo3)+(Bi4-Wo4)/4+(Bi5-Wo5)/4]/2$$

$$Go1=Gi1-Wo1 \quad \text{[Equation 7]}$$

Therefore, according to an embodiment, the display panel may realize blue color through the rendering of a first pixel among the first through fifth pixels that are neighboring to each other when the second through fifth pixels do not include a B sub-pixel. Therefore, each pixel may include only three sub-pixels, one of which is a white sub-pixel, while realizing a full color image. Thus, the same driving circuit as the driving circuit using RGB sub-pixels may be used, thereby preventing an area of the driving circuit, a charging time thereof, and a driving frequency thereof from changing without an increase in the number of scan channels or data channels.

Figure 7:
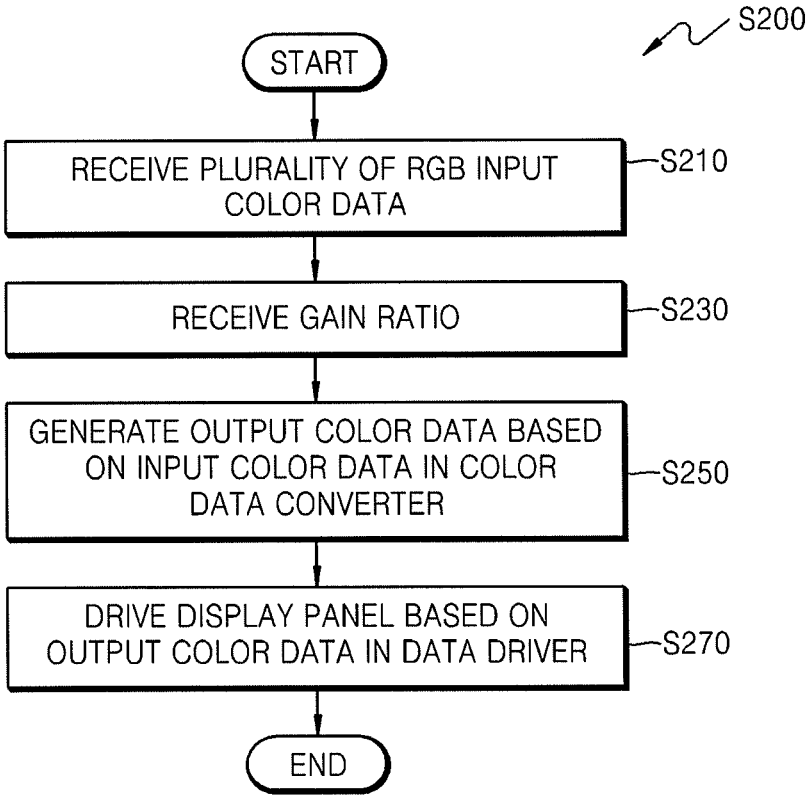
FIG. 7 illustrates a flowchart of a method of driving a display panel, according to an embodiment.

FIG. 7 illustrates a flowchart (S200) of a method of driving a display panel, according to an embodiment.

Referring to FIGS. 1 through 7, the color data converter 111 receives a plurality of RGB input color data (operation S210). For example, the color data converter 111 may receive the input color data Ri1, Gi1, and Bi1 with respect to a first pixel and the input color data Ri2, Gi2, and Bi2 with respect to a second pixel. The color data converter 111 may receive a gain ratio (operation S230). For example, the color data converter 111 may receive the first gain ratio ga1 with respect to the first pixel and the second gain ratio ga2 with respect to the second pixel. In this case, the first gain ratio ga1 with respect to the first pixel and the second gain ratio ga2 with respect to the second pixel may be identical to or different from each other according to an application example.

The color data converter 111 may generate output color data based on the input color data (operation S250). The color data converter 111 may generate the output color data in various ways according to an application example. Please see FIGS. 4A through 6B for the method of generating the output color data. The color data converter 111 may output and supply the output color data generated according to various application examples to the data driver 120. The data driver 120 may drive a display panel based on the output color data (operation S270).

Figure 8:
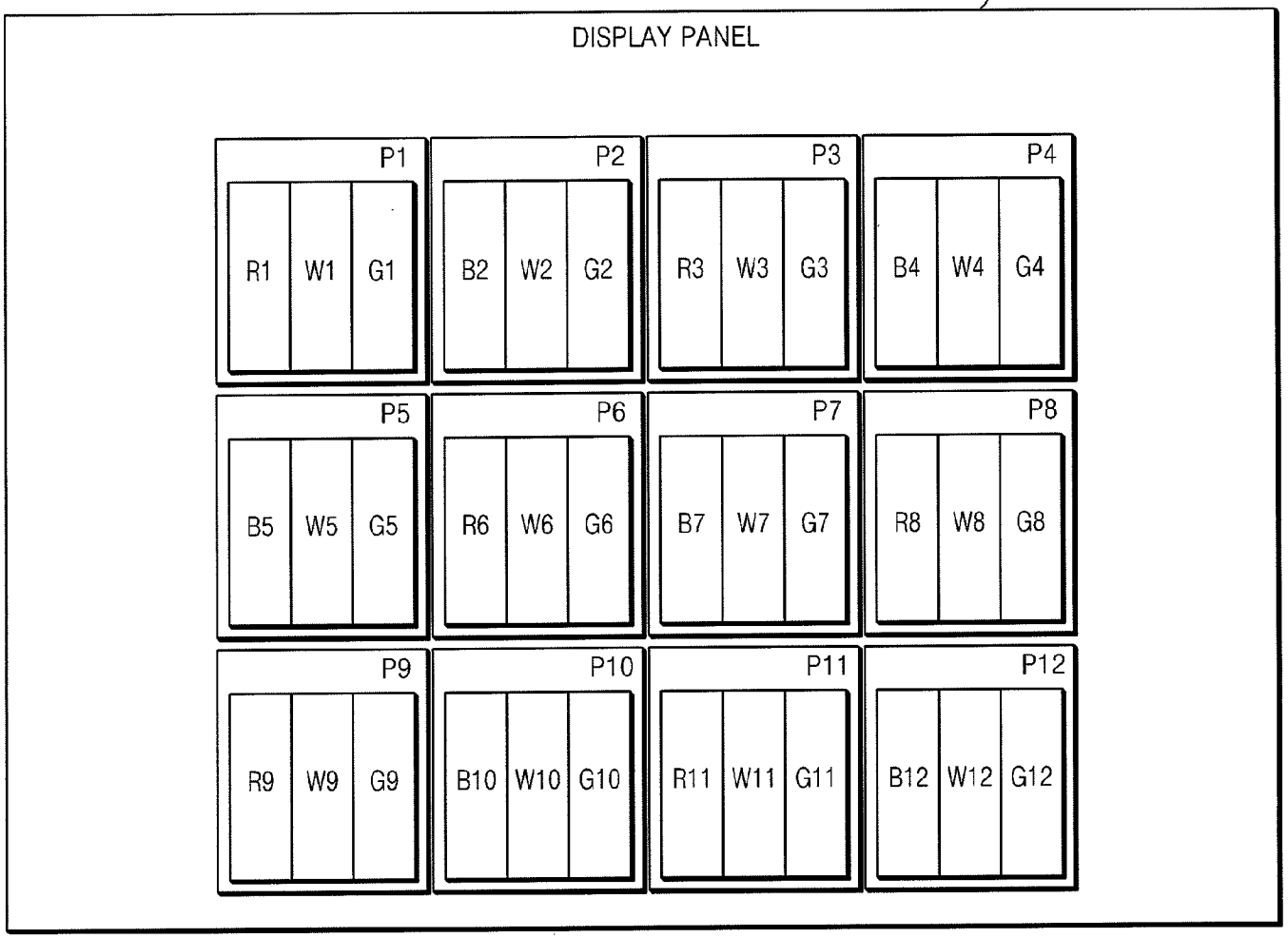
FIG. 8 illustrates a diagram of a display panel, according to an embodiment.

FIG. 8 illustrates a diagram of a display panel 200, according to an embodiment.

Referring to FIG. 8, each of pixels P1 through P12 includes G and W sub-pixels and, alternately, an R sub-pixel or a B sub-pixel. Each of pixels P1, P3, P5, P7, P9, and P11 do not include the B sub-pixel but do include the R sub-pixel. Each of pixels P2, P4, P6, P8, P10, and P12 do not include the R sub-pixel but do include the B sub-pixel.

For example, when the pixel P6 is driven, if a display device receives blue input color data corresponding to the pixel P6, since the pixel P6 has no B sub-pixel, the display panel 200 may realize the blue input color data corresponding to the pixel P6 through the B sub-pixel of the pixel P7 and/or the W sub-pixel of the pixel P6.

When the pixel P7 is driven, if the display device receives red input color data corresponding to the pixel P7, since the pixel P7 has no R sub-pixel, the display panel 200 may realize the red input color data corresponding to the pixel P7 through the R sub-pixel of the pixel P8 and/or the W sub-pixel of the pixel P7.

According to another embodiment, if the display device receives the blue input color data corresponding to the pixel P6, the display panel 200 may realize the blue input color data corresponding to the pixel P6 through the B sub-pixels of the pixel P5 and the pixel P7 that are neighboring to each other and/or the W sub-pixel of the pixel P6.

Also, if the display device receives red input color data corresponding to the pixel P7, the display panel 200 may realize the red input color data corresponding to the pixel P7 through the R sub-pixels of the pixel P6 and the pixel P8 that are neighboring to each other and/or the W sub-pixel of the pixel P7.

According to another embodiment, if the display device receives the blue input color data corresponding to the pixel P6, the display panel 200 may realize the blue input color data corresponding to the pixel P6 through the B sub-pixels of the pixels P2, P5, P7, and P10 that are neighboring to each other and/or the W sub-pixel of the pixel P6.

Also, if the display device receives red input color data corresponding to the pixel P7, the display panel 200 may realize the red input color data corresponding to the pixel P7 through the R sub-pixels of the pixels P3, P6, P8, and P11 that are neighboring to each other and/or the W sub-pixel of the pixel P7.

By way of summation and review, a display device including a white OLED according to embodiments described above uses a driving circuit used in an RGB OLED, thereby preventing an area of the driving circuit, a charging time thereof, and a driving frequency thereof from changing without an increase in the number of scan channels or data channels. In other words, in accordance with embodiments herein, when using the WOLED, pixels are still constructed to only have three sub-pixels, e.g., one green, one white, and one of red or blue. Therefore, conventional schemes for an RGB OLED may be employed. In contrast, previous uses of WOLED had pixels constructed using four sub-pixels, requiring redesign and increased cost of a driving circuit used therein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a first pixel including only three sub-pixels to emit red, green, and white light, respectively;

a second pixel neighboring the first pixel, the second pixel including only three sub-pixels to emit blue, green, and white light, respectively, wherein the display device includes only two kinds of pixels including the first pixel and the second pixel; and a color data converter to:

receive first input color data corresponding to the first pixel and second input color data corresponding to the second pixel, and generate first output color data each corresponding to red (R), green (G), and white (W) sub-pixels included in the first pixel and second output color data each corresponding to blue (B), green (G), and white (W) sub-pixels included in the second pixel, wherein each of the first input color data and the second input color data includes red, green, and blue input color data, wherein the first output color data for the red (R) sub-pixel is generated based on a first sum of a value obtained by multiplying the red input color data of the first input color data by a first weight and a value obtained by multiplying the red input color data of the second input color data by a second weight, wherein the second output color data for the blue (B) sub-pixel is generated based on a second sum of a value obtained by multiplying the blue input color data of the second input color data by the first weight and a value obtained by multiplying the blue input color data of the first input color data by the second weight, and wherein the first and second weights are 0.5, and wherein the color data converter is to:

determine first white output color data by extracting a minimum value from the first input color data and multiplying the extracted minimum value by a first gain ratio, determine second white output color data by extracting a minimum value from the second input color data and multiplying the extracted minimum value by a second gain ratio, calculate the red output color data of the first output color data by subtracting a value obtained by multiplying the first white output color data by the first weight and a value obtained by multiplying the second white output color data by the second weight from the first sum, and calculate the blue output color data of the second output color data by subtracting a value obtained by multiplying the second white output color data by the first weight and a value obtained by multiplying the first white output color data by the second weight from the second sum.

2. The display device as claimed in claim 1, wherein the color data converter is to generate the first output color data and the second output color data such that the red input color data of the second input color data is represented in the R sub-pixel of the first pixel and the blue input color data of the first input color data is represented in the B sub-pixel of the second pixel.

3. The display device as claimed in claim 1, wherein the color data converter is to generate the first output color data and the second output color data such that the red input color data of the first input color data and the second input color data is represented in the R sub-pixel of the first pixel, the W sub-pixel of the first pixel and the W sub-pixel of the second pixel, and the blue input color data of the first input color data and the second input color data is represented in the B sub-pixel of the second pixel, the W sub-pixel of the second pixel and the W sub-pixel of the first pixel.

4. The display device as claimed in claim 1, wherein there are a plurality of first and second pixels.

5. The display device as claimed in claim 4, further comprising a color data converter to:

receive a plurality of first input color data corresponding to the plurality of first pixels and a plurality of second input color data corresponding to the plurality of second pixels, and generate a plurality of first output color data each corresponding to R, G, and W sub-pixels included in the plurality of first pixels and a plurality of second output color data each corresponding to B, G, and W sub-pixels included in the plurality of second pixels.

6. The display device as claimed in claim 5, wherein the color data converter is to determine the plurality of first output color data and the plurality of second output color data such that red input color data of the plurality of second input color data is represented in the R sub-pixels of the plurality of first pixels, and blue input color data of the plurality of first input color data is represented in the B sub-pixels of the plurality of second pixels.

7. The display device as claimed in claim 5, wherein the color data converter is to determine the plurality of first output color data and the plurality of second output color data such that red input color data of the plurality of first input color data and the plurality of second input color data is represented the R sub-pixels of the plurality of first pixels, the W sub-pixels of the plurality of first pixels and the W sub-pixels of the plurality of second pixels, and blue input color data of the plurality of first input color data and the plurality of first input color data is represented in the B sub-pixels of the plurality of second pixels, the W sub-pixels of the plurality of second pixels and the W sub-pixels of the plurality of first pixels.

8. A display device, comprising:

a display panel including one or more unit pixels;

a data driver to supply three color data signals to each of the one or more unit pixels;

a gate driver to supply a gate-on voltage to the one or more unit pixels; and a timing controller to control the data driver and the gate driver, wherein the display panel includes:

a first pixel including only three sub-pixels to emit red, green, and white light, respectively; and a second pixel neighboring the first pixel and including only three sub-pixels to emit blue, green, and white light, respectively, wherein the display device includes only two kinds of pixels including the first pixel and the second pixel, wherein the timing controller is to:

receive red, green, and blue first input color data corresponding to the first pixel, and red, green, and blue second input color data corresponding to the second pixel, and generate first output color data each corresponding to red (R), green (G), and white (W) sub-pixels included in the first pixel and second output color data each corresponding to blue (B), green (G), and white (W) sub-pixels included in the second pixel, wherein the first output color data for the red (R) sub-pixel is generated based on a first sum of a value obtained by multiplying the red first input color data by a first weight and a value obtained by multiplying the red second input color data by a second weight, wherein the second output color data for the blue (B) sub-pixel is generated based on a second sum of a value obtained by multiplying the blue second input color data by the first weight and a value obtained by multiplying the blue first input color data by the second weight, and wherein the first and second weights are 0.5, and wherein the timing controller is to:

determine first white output color data by extracting a minimum value from the red, green, and blue first input color data and multiplying the extracted minimum value by a first gain ratio, determine second white output color data by extracting a minimum value from the red, green, and blue second input color data and multiplying the extracted minimum value by a second gain ratio, calculate the red output color data of the first output color data by subtracting a value obtained by multiplying the first white output color data by the first weight and a value obtained by multiplying the second white output color data by the second weight from the first sum, and calculate the blue output color data of the second output color data by subtracting a value obtained by multiplying the second white output color data by the first weight and a value obtained by multiplying the first white output color data by the second weight from the second sum.

9. The display device as claimed in claim 8, wherein the timing controller is to generate the first output color data for the first pixel and the second output color data for the second pixel such that the red first input color data and the red second input color data are represented in R sub-pixel of the first pixel, the W sub-pixel of the first pixel, and the W sub-pixel of the second pixel, and the blue first input color data and the blue second input color data are represented in the B sub-pixel of the second pixel, the W sub-pixel of the second pixel and the W sub-pixel of the first pixel.

10. The display device as claimed in claim 8, wherein there are a plurality of first and second pixels.

11. The display device as claimed in claim 8, wherein the timing controller is to supply the first output color data and the second output color data to the data driver.

12. The display device as claimed in claim 8, wherein the three data signals supplied by the data driver are three data signals corresponding to red, green, and white output color data or three data signals corresponding to blue, green, and white output color data.

13. A method of driving a display panel, the method comprising:

receiving first input color data corresponding to a first pixel and second input color data corresponding to a second pixel; and generating first output color data each corresponding to red (R), green (G), and white (W) sub-pixels included in the first pixel and second output color data each corresponding to blue (B), green G, and white W sub-pixels included in the second pixel, wherein the first pixel includes only the R, G, and W sub-pixels, the second pixel includes only the B, G, and W sub-pixels, each of the first input color data and the second input color data includes red, green, and blue input color data, the display panel includes only two kinds of pixels including the first pixel and the second pixel, generating the first output color data for the R sub-pixel is based on a first sum of a value obtained by multiplying the red input color data of the first input color data by a first weight and a value obtained by multiplying the red input color date of the second input color data by a second weight, generating the second output color data for the B sub-pixel is based on a second sum of a value obtained by multiplying the blue input color data of the second input color data by the first weight and a value obtained by multiplying the blue input color data of the first input color data by the second weight, the first and second weights are 0.5, generating the first output color data and the second output color data comprises:

determining first white output color data by extracting a minimum value from the first input color data and multiplying the extracted minimum value by a first gain ratio, determining second white output color data by extracting a minimum value from the second input color data and multiplying the extracted minimum value by a second gain ratio, calculating the red output color data of the first output color data by subtracting a value obtained by multiplying the first white output color data by the first weight and a value obtained by multiplying the second white output color data by the second weight from the first sum, and calculating the blue output color data of the second output color data by subtracting a value obtained by multiplying the second white output color data by the first weight and a value obtained by multiplying the first white output color data by the second weight from the second sum.

14. The method as claimed in claim 13, wherein the red input color data of the first input color data and the second input color data is represented in the R sub-pixel of the first pixel, the W sub-pixel of the first pixel and the W sub-pixel of the second pixel, and the blue input color data of the first input color data and the second input color data is represented in the B sub-pixel of the second pixel, the W sub-pixel of the second pixel and the W sub-pixel of the first pixel.

15. The method as claimed in claim 13, further comprising:

receiving the first output color data and the second output color data, wherein a data driver performs the receiving;

supplying a gate-on voltage to a plurality of unit pixels, wherein a gate driver performs the supplying; and supplying a data signal to each pixel corresponding to the first output color data and the second output color data, wherein the data driver performs the supplying.

* * * * *